US005575557A

United States Patent [19]

Huang et al.

[11] Patent Number: 5,575,557

[45] Date of Patent: Nov. 19, 1996

[54] MOTION SENSOR LIGHT APPARATUS

[75] Inventors: Zhao Y. Huang, Canton, China; E. Robert Kunzler, San Diego, Calif.

[73] Assignee: Merritway Electrical Industries Co. Ltd., Canton, China

[21] Appl. No.: 514,538

[22] Filed: Aug. 14, 1995

[51] Int. Cl.[6] ..... F21V 25/00

[52] U.S. Cl. ..... 362/276; 362/432; 362/802

[58] Field of Search ..... 362/145, 149, 362/276, 362, 369, 432, 802; 340/569, 573

[56] References Cited

U.S. PATENT DOCUMENTS

| | | | |
|---|---|---|---|
| 5,282,118 | 1/1994 | Lee | 362/276 |
| 5,442,532 | 8/1995 | Boulos | 362/432 |

*Primary Examiner*—Denise L. Gromada
*Assistant Examiner*—Y. Quach
*Attorney, Agent, or Firm*—Foster & Foster

[57] ABSTRACT

A motion sensor light apparatus comprises a lighting body, a mounting base for mounting the lighting body to a wall. The lighting body includes a decorative house for receiving a lamp bulb, and a light base extended downwardly from the bottom end of the decorative house as an integral part of the lighting body. The light base has a top rim, a conical base body extending coaxially and downwardly from the top rim and gradually reducing its diameter to define a conical shape, and a flat bottom end extending downwardly from the base body. The base body has an azimuthal aperture and installs therein a lens, a seat, and a motion sensor circuit board mounted on the seat. The seat has an azimuthal seat aperture superimposing to the aperture of the base body. The lens is adhered to the seat and positioned between the seat aperture and the aperture of the base body, and directs infra-red radiation from a human or vehicle object to an infra-red sensor of the motion sensor circuit board. So that the light apparatus can eliminate the conventional extra housing part and incorporate with or without a decorative tail piece. Furthermore, the motion sensor light apparatus can utilize the minimum components to achieve the maximum effects that it simplifies the electric connecting configuration of the motion sensor circuit board and the lamp bulb, it is easy to detach apart for reparation, and it is easier to assemble.

6 Claims, 5 Drawing Sheets

MOTION SENSOR LIGHT APPARATUS

BACKGROUND OF THE PRESENT INVENTION

The present invention relates to a light apparatus, and more particularly to a motion sensor light apparatus which enables the motion sensor and the lens to be installed within its light base so as to eliminate the conventional housing structure and enable the motion sensor light apparatus incorporating with or without a decorative tail piece.

The technical of utilizing motion sensor to receive infra-red radiation from a human being or vehicle within a certain distance has been known for a while. Conventional motion sensor lighting fixture comprises a lighting apparatus, and an infra-red motion detector which is mounted on a mounting case and installed adjacent to the lighting apparatus. The motion detector or sensor is responsive to the infra-red radiation emitted by humans or vehicles and turns on the lighting apparatus when it receives the infra-red from the humans or vehicles within a predetermined distance.

Mr. Lee's U.S. Pat. No. 5,282,118 issued Jan. 25, 1994 disclosed a lighting fixture with motion detector, which improved the deficiencies of the above prior structure that the case and motion detector might appear incongruent yard out of place. An extra housing 15 has been used and locates between a cylindrical light base 17 and a decorative tail piece 18 of the lighting fixture. The housing has a generally curved convexo-convex shape and comprises a generally convex bottom portion and a generally convex top portion defining convexo-convex shape. The generally convex bottom portion has an upwardly curve bottom wall with an azimuthally extending lens aperture 152 formed thereon. An infra-red sensor 121 responsive to infra-red radiation is mounted within the housing in view of the lens aperture 152. A plastic lens member 153 covers the lens aperture 152 and forms to conform to the curvature of the generally convex bottom portion. The lens member 153 has a plurality of Fresnel lenses formed on the inner surface thereof and disposed to direct infra-red radiation to the sensor 121.

Lee's patent enables the lighting fixture, which includes a long, downward extending, decorative tail piece, to incorporate with a motion sensor that will not obstruct the field of view by the tail piece. So that Lee's patent avoids the obstruction problem happened in the conventional lighting fixture. It is obvious that the conventional lighting fixture is only suitable for a design without the tail piece.

Since Lee's patent uses an extra housing to receive the motion sensor and lens, Lee's patent is specialized in a lighting fixture design with tail piece and does not match the design of lighting fixture without tail piece. However, the extra housing must be supplied with the lighting fixture, which adds to the inventory of parts that must be maintained and amount of the product packaging. At the stone time, the cost of the lighting fixture of Lee's patent is unnecessary increased.

Referring to FIG. 1 which illustrates a cross section view of the interior structure of the Lee's patent, electric wires 111,112 are required to connected the motion sensor circuit board 12 and the lamp bulb 13 to an electrical controlling circuitry box 121 which is received in a supporting platform 101, wherein the motion sensor circuit board 12 is mounted on a supporter 14 within the housing 15 and the lamp bulb socket 16 is installed within the cylindrical light base 17 of the lighting fixture 10. The supporter 14 has two screw heads 141, 142 at its two ends 143, 144 respectively and the motion sensor circuit board 12 is stuck between the two ends 143, 144 of the supporter 14. The upper screw head 141 of the supporter 14 connects to the bottom of the light base 17 and the lower screw head 142 of the support 14 connects to the top end of the tail piece 18 by means of a screw rod 19. One end of an electric wire 111 is connected to the motion sensor circuit board 12. The other end of the electric wire must be extended upwardly to pass through the hollow screw rod 19, an upper opening 151 of the housing 15 and a bottom hole 171 of the light base 17 so as to connect with the electrical controlling circuitry box 121 via the light base 17.

In view of the interior structure of the Lee's patent as disclosed above, it is difficult and takes much time to assemble the housing 15, the supporter 14, the motion sensor circuit board 12, the lamp bulb socket 16, and the light base 17, and to electrically connect the motion sensor board 12 and the lamp bulb socket 16 to the electrical controlling circuitry box 121ted with the lamp bulb socket 16 by means of the electric wires 111, 112. Moreover, once the motion sensor circuit board 12 electrically connects with the electrical controlling circuitry box 121, it can not be detached apart without electric disconnection that complicates the reparation of any electric damage and occupies more operating time.

It is well known in art that the higher the lens of a motion sensor lighting fixture located, the larger field of view can be detected. Thus, suppliers and producers of the lighting fixture highly desire to design a lighting fixture with its detecting lens located as high as possible.

SUMMARY OF THE PRESENT INVENTION

The main object of the present invention is to provide a motion sensor light apparatus which enables the motion sensor arrangement such as the motion sensor circuit board and lens to be installed within its light base so as to eliminate the extra conventional housing part and other supporting components therein, no matter the light apparatus has or hasn't the decorative tail piece.

Another object of the present invention is to provide a motion sensor light apparatus which can utilize the minimum pans and components to achieve the maximum effects that it simplifies the electric connecting arrangement between the motion sensor circuit board and the electrical controlling circuitry box, it is easy to detach apart for reparation, and it is easier to assemble.

Another object of the present invention is to provide a motion sensor light apparatus for which its lens is able to mount on a possible highest position for detecting a larger field of view.

Accordingly, the present invention provides a motion sensor light apparatus which comprises a lighting body, mounting base for mounting the lighting body to a wall. The lighting body includes a decorative house for receiving a lamp bulb and a light base extended downwardly from the bottom end of the decorative house as an integral part of the lighting body. The light base has a top rim extended downwardly from the decorative house, a conical base body extended coaxially and downwardly from the bottom of the top rim and gradually reduced its diameter to define a conical shape, and a flat bottom end extended downwardly from the bottom of said base body. The base body has a front azimuthal aperture and installs therein a lens, a seat, and a motion sensor circuit board mounted on the seat. The seat has an azimuthal seat aperture superimposing to the aperture of the base body. The lens is adhered to the seat and positioned between the seat aperture and the aperture of the base body. Infra-red radiation from a human or vehicle object can be directed by the lens to an infra-red sensor of the motion sensor circuit board. Since the motion sensor arrangement is install to the integral base body of the light apparatus, it eliminates the extra conventional housing pan and other supporting components therein, no matter the light apparatus has or hasn't the decorative tail piece. Accordingly, the motion sensor light apparatus can utilize the minimum parts and components to achieve the maximum effects that it simplifies the electric connecting arrangement between the motion sensor circuit board and the electrical controlling circuitry box, it is easy to detach apart for reparation, and it is easier to assemble.

DETAILED DESCRIPTION OF THE PREFERRED EMBODIMENT

Figure 1:
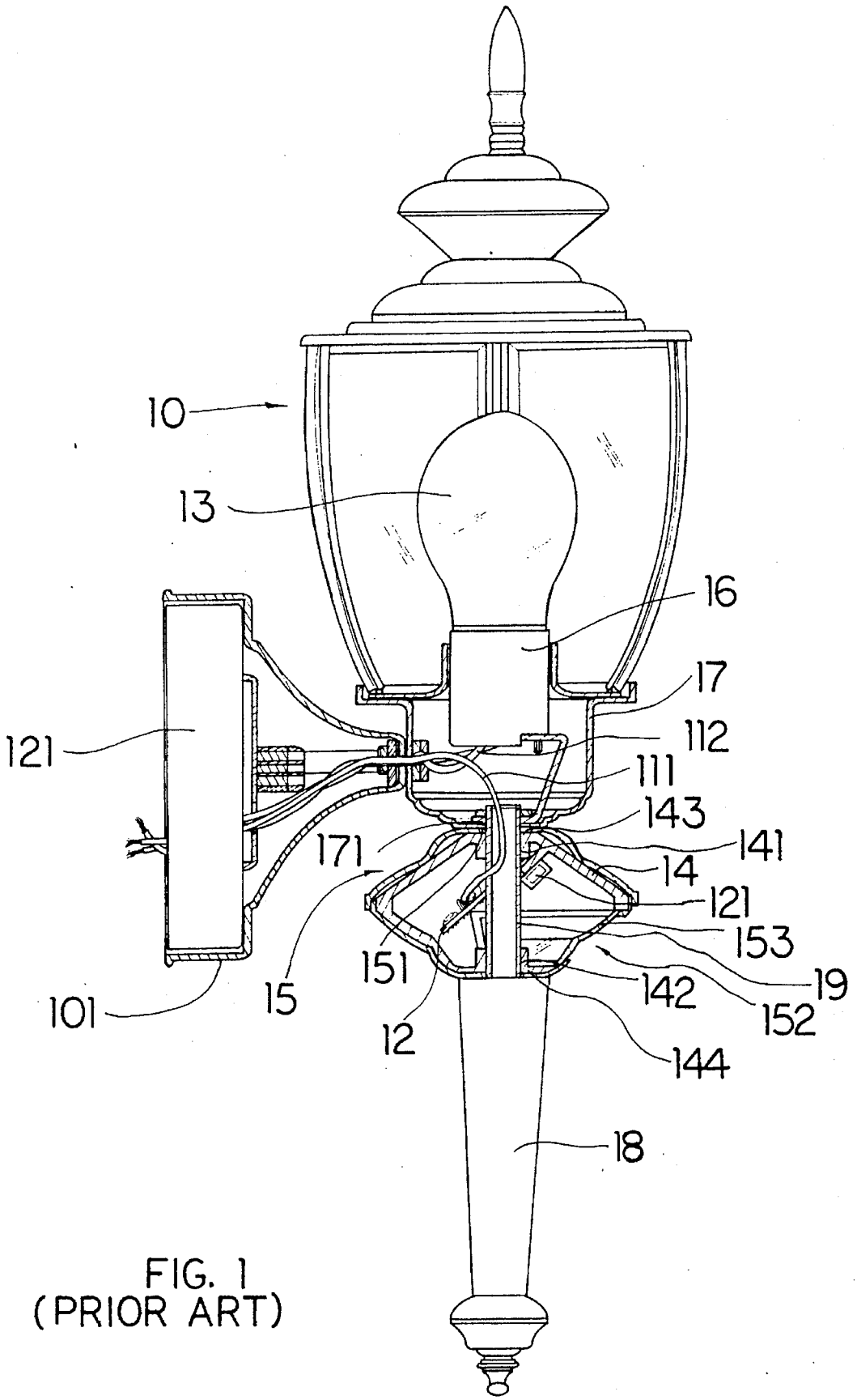
FIG. 1 (PRIOR ART)
FIG. 1 is a partial sectional view of a conventional motion sensor lighting fixture with an extra housing structure.
Figure 2:
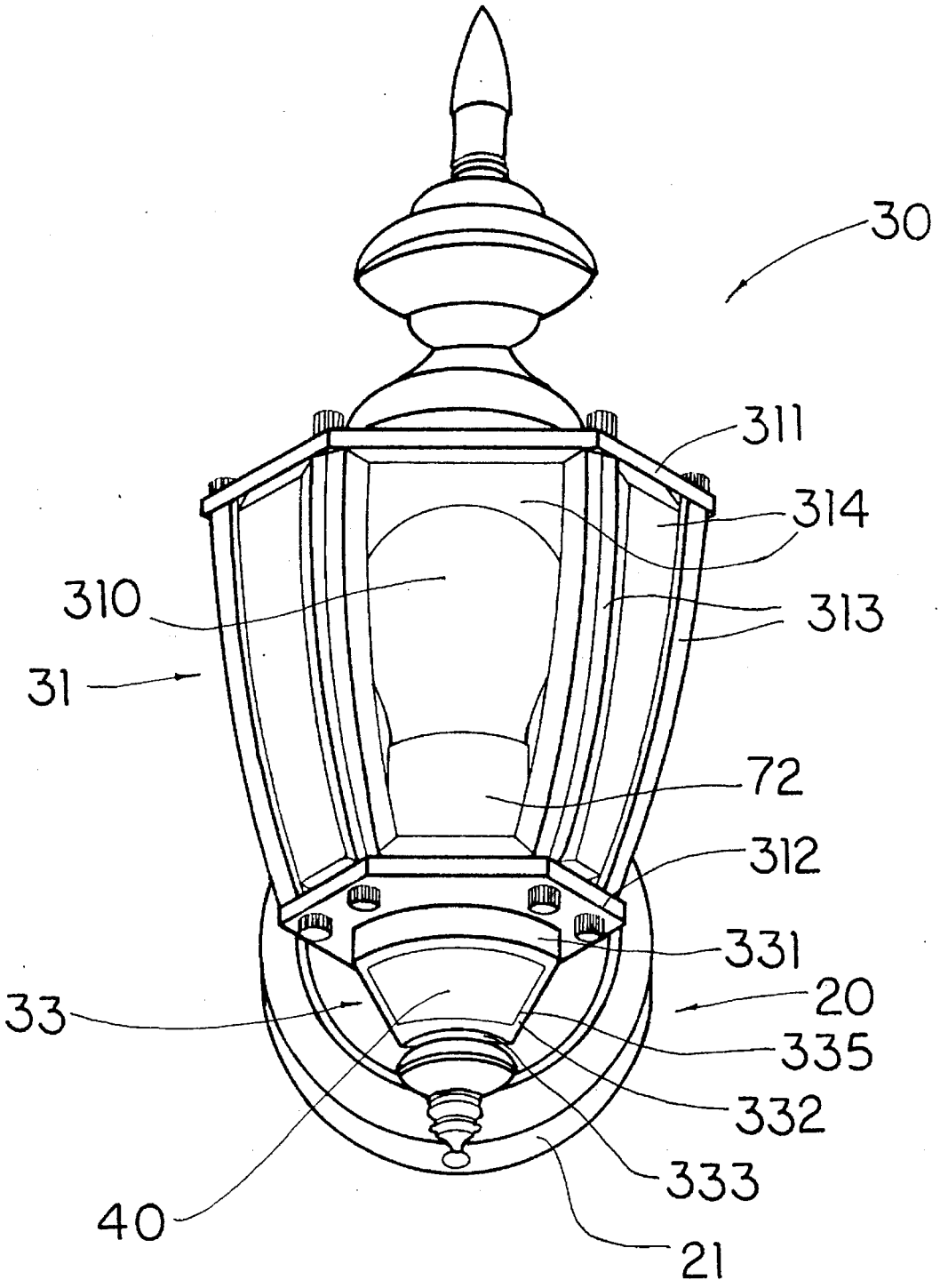
FIG. 2 is a perspective view of a motion sensor light apparatus without tail piece according to a preferred embodiment of the present invention.
Figure 3:
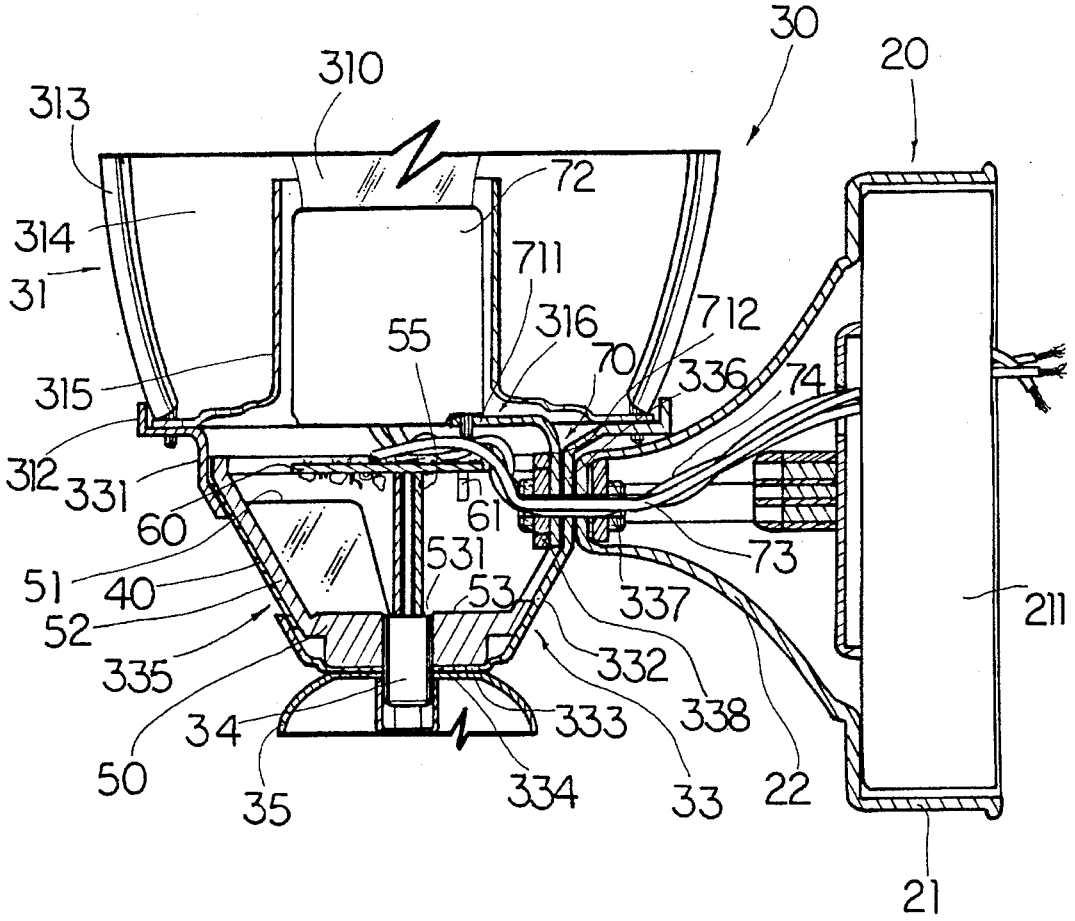
FIG. 3 is a partial sectional view of FIG. 2.
Figure 4:
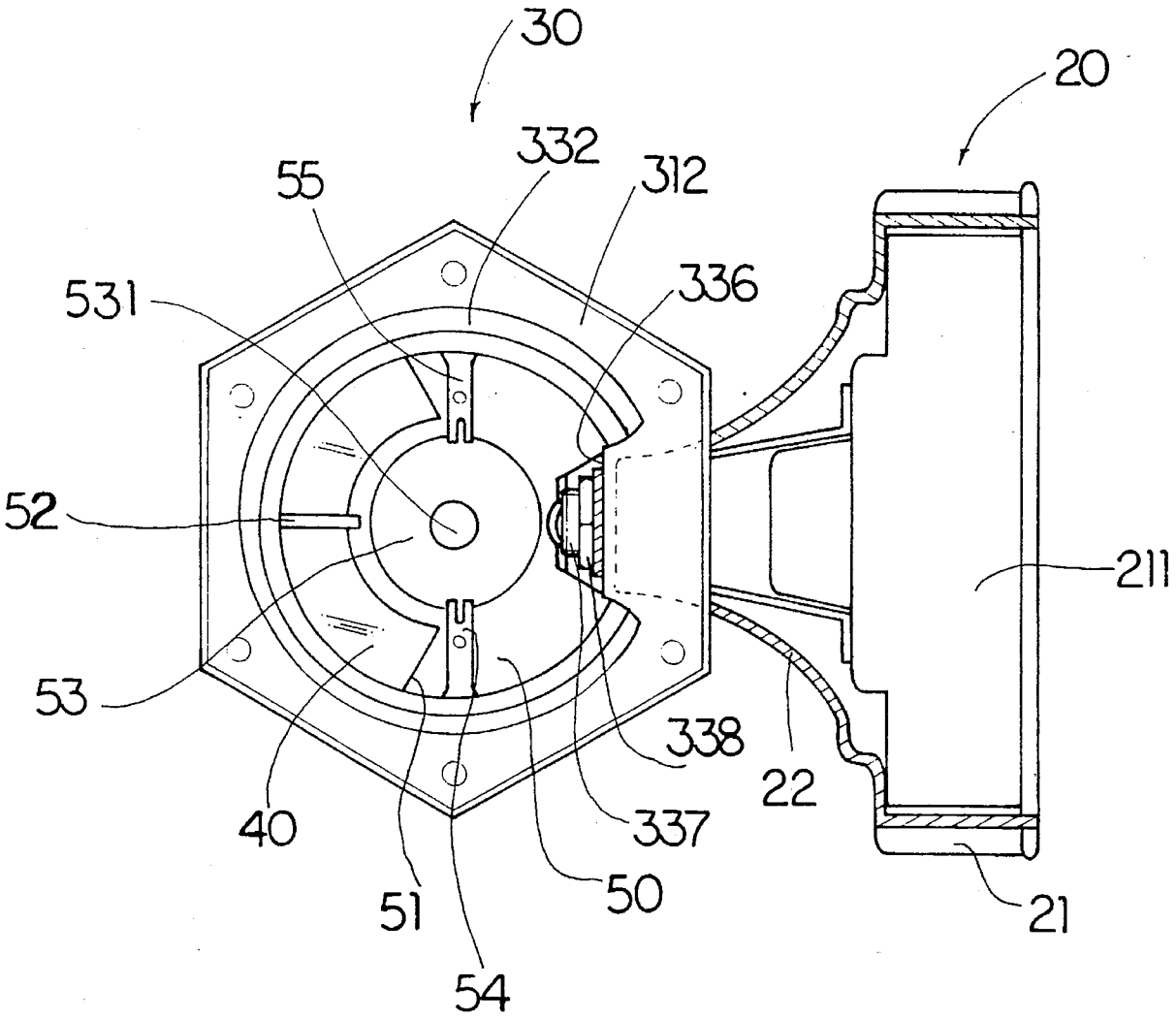
FIG. 4 is a top view of the light base of a motion sensor light apparatus according to the above embodiment of the present invention, in which the motion sensor circuit board is removed for illustration of the seat.

Referring to FIG. 2 to 4 of the drawings, a motion sensor light apparatus in accordance with the present invention comprises a mounting base 20, and a lighting body 30 which is mounted to a wall by means of the mounting base 20. The lighting body 30 comprises a decorative house 31 for receiving a lamp bulb 310, and a light base 33 extended downwardly from a bottom end of the decorative house 31 as an integral part of the lighting body 30.

As shown in FIG. 2, 3 and 4, the mounting base 20 has a rounded platform 21 and a conical supporter 22. The platform 21 is installed to a wall and receives a conventional electrical controlling circuitry box 211 including a first and a second amplifying circuits, a logic control circuit, a photo-control circuit (CDS control), a delay time control, and a switch circuit, etc.(not shown in the Figures). The supporter 22 extends from the platform 21 and reduces its diameter along the axis of the platform 21 to form a conical shape for connecting with the light base 33 of the lighting body 30 by screwing Accordingly, the entire lighting body 30 can be firmly held in position by means of its mounting base 20.

The decorative house 31 of the lighting body 30 includes a top house cover 311, a house bottom platform 312, a plurality of supporting ribs 313, a plurality of glasses 314, and a lamp socket holder 315. In which, the supporting ribs 3 13 are spacedly screwed in position between the house cover 311 and the bottom platform 312 in order to mount the glasses 314 between the supporting ribs 313 respectively. The lamp socket holder 315 is positioned in the decorative house 31 and mounted on the house bottom platform 312.

The light base 33 is extended concentrically and downwardly from the house bottom platform 312 as an integral part of the lighting body 30. The house bottom platform 312 has a central circular opening 316. The light base 33 is composed of a top rim 331, a conical base body 332 and a flat bottom portion 333 in which the top rim 331 is formed by extending continuously and downwardly from the circumference of the opening 316 of the house bottom platform 312.

The base body 332 is extended coaxially and downwardly from the bottom of the top rim 331 and gradually reduces its diameter to define a conical shape with an acute angle of 70 degrees. The bottom portion 333 is a circular rim with a flat bottom side extended from the bottom end of the base body 332 that the bottom portion 333 has a diameter smaller than the bottom end of the base body 332. The center of the bottom portion 333 has a hole 334 for installing a connector 34 which is a bolt with two threaded ends. A front lens aperture 335 is provided in the front surface of the conical base body 332 while the opposite back surface of the base body 332 forms a vertical connecting surface 336 for firmly securing with the free end of the supporter 22 of the mounting base 20 by a hollow bolt 337 and at least a nut 338. The lens aperture 335 is in azimuthal shape and has a top and a bottom horizontal sides adjacent to the top rim 331 and the bottom portion 333 respectively. The width between the right and the left sides of the lens aperture 335 on the front surface of the base body 332 that refers to an angle extent of 160 degrees.

Within the base body 332, a lens 40, a seat 50, and a motion sensor circuit board 60 which has one or more infra-red sensor 61 is installed. The lens 40, which can direct infra-red radiation from a human or vertical object to the sensor 61 and has a size slightly larger than the lens aperture 335, is positioned in the base body 332 to cover the lens aperture 335. A plurality of Fresnel lenses are formed on the inner surface of the lens 40. The seat 50 is a conical, flat bottom, hollow cup having an external shape and size substantially equal to the internal shape and size of the base body 332. The seat 50 has a front azimuthal seat aperture 51 having a shape and size substantially equal to the shape and size of the lens aperture 335 of the base body 332. Vertically positioned between the huddle portions of the top side and the bottom side of the seat aperture 51 is a middle rib 52. The lens 40 is adhered to cover the seat aperture 51 and be supported by the middle rib 52 for maintaining its curvature. The seat 50 is disposed in the base body 332 with its seat aperture 51 superimposing with the lens aperture 335 of the base body 33 so as to hold and support the lens 40 firmly in a position coveting the lens aperture 335. The flat bottom 53 of the seat 50 has a central screw hole 531. One threaded end of the connector 34 is screwed to the central screw hole 53 1 while the other threaded end of the connector 34 is screwed with a base head 35 so as to connect and secure the seat 50 and the light base 33 in position.

The seat 50 further comprises at least two supporting shoulders 54, 55 which are protruded on two opposing inner sides adjacent to the right side and left side of the seat aperture 51 respectively. The motion sensor circuit board 60 is horizontally positioned on the seat 50 by adhering or screwing to the two supporting shoulders 54, 55. The infra-red sensor 61 of the motion sensor circuit board 60 should be located in an upper position and in view of the lens 40 that the infra-red radiation from a human or vehicle object can be directed by the lens 40 to the infra-red sensor 61 and defined a plurality of individual fields of view. The aggregate of these individual fields of view defines the overall field of view. Such that the lens 40 and the infra-red sensor 61 are arranged to function with one another in motion detection relation for triggering the light of the motion sensor light apparatus of the present invention when a warm object is within detective range.

An L-shape stand 70 has a longitudinal portion 711, and a latitudinal portion 712 which is mounted to the inner side of the vertical connecting surface 336 of the light base 33 by the hollow bolt 337 and nut 338 connection, as shown in FIG. 3, for mounting a lamp bulb socket 72 on its longitudinal portion 711. So that the lamp bulb socket 72 can be positioned within the lamp socket holder 315 of the decorative house 31 for coupling the lamp bulb 310. Electric wires 73, 74 are simply connected the motion sensor circuit board 60 and the lamp bulb socket 72 with the electrical controlling circuitry box 211 within the platform 21 of the mounting base 20.

Figure 5:
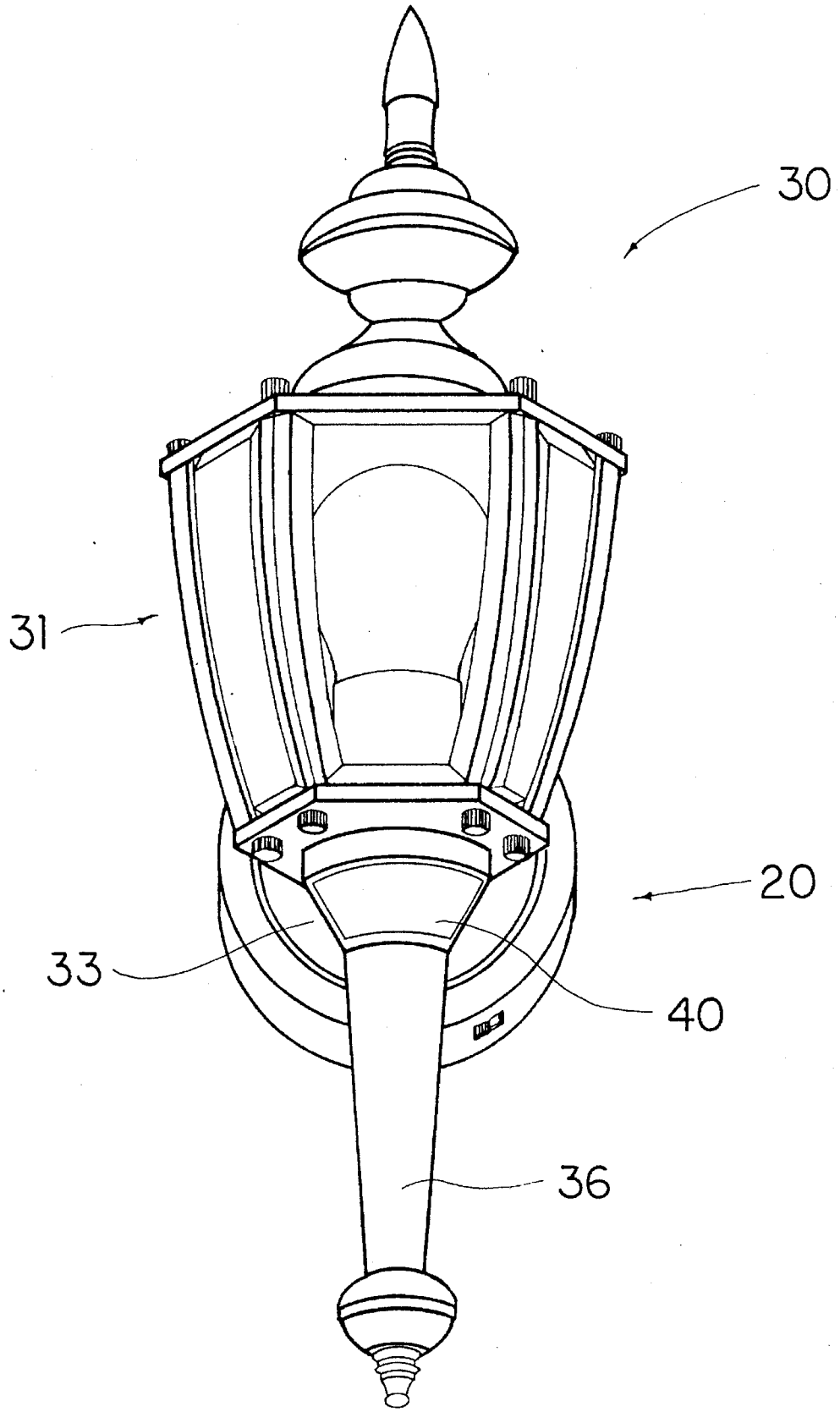
FIG. 5 is a perspective view of a motion sensor light apparatus with a decorative tail piece of the present invention.

An alternative embodiment is illustrated in FIG. 5 in which the other threaded end of the connector 34 (as shown in FIG. 3) can be connected with a long decorative tail piece 36. Thus, the present invention is capable of incorporating with or without the decorative tail piece.

The above arrangement provides unexpected results that overcomes a plurality of drawbacks of the conventional lighting fixture as follows:

Since the motion sensor arrangement of the present invention is arranged in the conical light base 33, a plurality of conventional components, such as the extra housing, supporting stand used in the housing, etc., can be eliminated. At the same time, the position of the lens 40 of the present invention can be mounted in a higher position to detect a larger field of view.

Due to the improved configuration of the present invention, the electrical connecting wiring arrangement between the motion sensor circuit board 60, the lamp socket holder 315, and the electrical controlling circuitry box 211 of tile present invention is simplified. So that it is easy to assemble or to detach apart the components such as the light base 33 from the mounting base 20 and the lighting body 30 for reparation. Accordingly, the present invention can utilize the minimum parts and components to achieve the maximum effects.

In accordance with the actual integral configuration of installing the motion sensor arrangement within the light base 33 of the present invention, no extra housing is required, and thus the present invention has a broader application that it can be applied to a light apparatus which has or hasn't the decorative tail piece.

I claim:

1. A motion sensor light apparatus, comprising a wall mounted mounting base having an electrical controlling circuitry box disposed therein;

a lighting body comprising a decorative house which has a lamp socket holder disposing therein and coupling with a lamp bulb socket a house bottom platform having a central circular opening, and a light base;

said light base extended concentrically and downwardly from said house bottom platform comprising a top rim, a conical base body and a bottom portion; in which said top rim is formed by extending continuously and downwardly from a circumference of said opening of said house bottom platform, said base body is extended coaxially and downwardly from a bottom of said top rim defining a vertical connecting surface and gradually reduces its diameter to define a conical shape with a predetermined acute angle, and said bottom portion is a circular rim with a flat bottom side extended from the bottom portion of said base body;

said base body having a front lens aperture provided on its front surface, and said vertical connecting surface formed on its opposite back surface firmly securing to said mounting base; said lens aperture is in azimuthal shape and has a top and a bottom horizontal side adjacent to said top rim and said bottom portion respectively, and the width between a right and a left side of said lens aperture having an angle extent of 160 degrees;

a seat, winch is a flat bottom conical hollow cup, having an external shape and size substantially equal to the internal shape and size of said base body, and having a front azimuthal seat aperture provided thereon; said seat aperture has a shape and size substantially equal to the shape and size of said lens aperture of said base body and a middle rib vertically positioned between the middle portions of a top side and a bottom side of said seat aperture; said seat further having at least two supporting shoulders protruded on two opposing inner sides adjacent to a right side and a left side of said seat aperture respectively;

a lens, which can direct infra-red radiation from at least a human and a vehicle object, having a size slightly larger than said lens aperture of said base body and being positioned in said base body to cover said lens aperture; said lens being adhered to said seat to cover said seat aperture and being supported by said middle rib maintaining its curvature;

said seat being disposed in said base body with said seat aperture superimposing with said lens aperture of said base body to hold and support said lens firmly in a position covering said lens aperture;

an infra-red motion sensor circuit board, which is horizontally mounted on said two supporting shoulders of said seat, having an infra-red sensor located in an upper position with respect to said flat bottom portion that the infra-red radiation from at least the human and the vehicle object can be directed by said lens to said infra-red sensor;

a stand which is mounted to an inner side of said vertical connecting surface of said light base mounting said lamp bulb socket in said decorative house; and electric wires connecting said motion sensor circuit board and said lamp bulb socket with said electrical controlling circuitry box respectively.

2. A motion sensor light apparatus as recited in claim 1, further comprising a connector and said light base having a hole in a center of said bottom portion, in which one end of said connector is connected to the flat bottom of said seat via said hole, and another end of said connector is connected with a base head.

3. A motion sensor light apparatus, as recited in claim 2, wherein said connector is a bolt, said one end of said connector has a threaded end and said flat bottom of said seat has a central screw hole screwing with said threaded end of said connector while said another end of said connector has another threaded end screwing to said base head.

4. A motion sensor light apparatus, as recited in claim 1, further comprising a connector and said light base having a hole in the center of said bottom portion, in which one end of said connector is connected to the flat bottom of said seat via said hole, and another end of said connector is connected with a long decorative tail piece.

5. A motion sensor light apparatus, as recited in claim 4, wherein said connector is a bolt, said one end of said connector has a threaded end and said flat bottom of said seat has a central screw hole screwing with said threaded end of said connector while said another end of said connector has another threaded end screwing to said tail piece.

6. A motion sensor light apparatus, recited in claim 1, wherein said stand is an L-shape and has a longitudinal portion and a latitudinal portion, said latitudinal portion is mounted to said vertical connecting surface of said base body and said longitudinal portion is mounted to a bottom of said lamp bulb socket to support said lamp bulb socket positioning in said decorative house.

* * * * *